United States Patent [19]

Do et al.

[11] Patent Number: 4,619,537

[45] Date of Patent: Oct. 28, 1986

[54] RIBBON FEED WITH INK DEPLETION COMPENSATION

[75] Inventors: Phuc K. Do; Carol E. Wyke; Barnes R. Kendrick, Jr., all of Charlotte; Dennis R. Hedrick, High Point; Demetrios Troupes, Charlotte, all of N.C.

[73] Assignee: International Business Machines Corporation, Armonk, N.Y.

[21] Appl. No.: 737,187

[22] Filed: May 23, 1985

[51] Int. Cl.[4] ..... B41J 33/14; B41J 33/36

[52] U.S. Cl. ..... 400/225; 400/229; 400/232

[58] Field of Search ..... 400/225, 229, 232

[56] References Cited

U.S. PATENT DOCUMENTS 4,530,612 7/1985 Butera et al. ..... 400/225

FOREIGN PATENT DOCUMENTS 148681 9/1982 Japan ..... 400/225
194593 11/1983 Japan ..... 400/225
57761 4/1984 Japan ..... 400/225

OTHER PUBLICATIONS

Evans et al, "Variable Ribbon Incrementation", IBM Technical Disclosure Bulletin, vol. 22, No. 8B, p. 3484, 1/80.

Loeffler, "Ribbon Control . . . ", IBM Technical Disclosure Bulletin, vol. 21, No. 5, pp. 1998–1999, 10/78.

*Primary Examiner*—William Pieprz

*Attorney, Agent, or Firm*—Bell, Seltzer, Park & Gibson

[57] ABSTRACT

Where the ribbon advance mechanism of a printer is driven by the motion of the print head carrier, ink in the ribbon will be differentially depleted depending upon the density of print. This varied depletion becomes a problem for printers capable of printing high density graphics images, particularly color filled images. In accordance with this invention, the printing density is monitored and when the printing density exceeds a predetermined value, the print head is caused to be moved an amount greater than that necessary to position the print head at a succeeding print position so as to thereby cause additional ink ribbon to be advanced and to avoid overprinting on areas of the ribbon where high density printing has occurred.

14 Claims, 6 Drawing Figures

RIBBON FEED WITH INK DEPLETION COMPENSATION

FIELD AND BACKGROUND OF THE INVENTION

This invention relates to printers for printing data on a print medium, and more particularly to an improvement in the printer and its method of operation by which the ink ribbon is advanced in a way which will avoid problems due to ink depletion in the ribbon.

Ribbon ink depletion is recognized as a problem for printers capable of printing dense patterns or graphics. The ribbon is typically moved at a slower rate of speed than the print head carrier, and ink depletion occurs when successive dense patterns on a line overprint a section of the ribbon. This overprinting causes the images of later patterns to be printed lighter, and this is undesirable, particularly when printing color-filled images.

A number of approaches have been taken in addressing this problem. The most popular solution has employed a motor to continually drive the ribbon, and has been adopted in many small and intermediate printers. However, the use of a separate ribbon feed motor adds significantly to the cost of the printer, and may result in a higher than desirable rate of ribbon consumption.

In many printers, particularly the smaller, lower cost printers, the ink ribbon is advanced by a mechanical linkage between the ribbon drive and the print head carrier motor so that movement of the print head by the carrier motor will also advance the ribbon. Differential ribbon ink depletion is especially troublesome in this type of printer.

An object of the present invention is to provide a method and means for intelligently advancing the ribbon in a printer to avoid ribbon ink depletion, and which is suitable for use in a printer of the above-described type wherein movement of the print head controls the advancement of the ink ribbon.

SUMMARY OF THE INVENTION

In accordance with the present invention, the problems associated with ribbon ink depletion are overcome by an apparatus and method which involve detecting when the printing density exceeds a predetermined threshold value, and in response to this predetermined threshold value being exceeded, moving the print head an amount greater than that which is necessary to position the print head at a succeeding print position so as to thereby cause additional fresh ribbon for succeeding printing to be advanced from the supply and to thereby avoid overprinting on areas of the ink ribbon where high density printing has occurred. As each buffer of print information is printed, the length and print density is examined, and when the print density threshold is exceeded, the amount of additional print head movement which is required to advance the ink ribbon a sufficient distance for receiving the next succeeding buffer of print information is computed and the print head is moved this extra distance while being repositioned for succeeding printing.

A printer embodying the features of the present invention comprises:

a print head mounted for movement relative to a print medium;

a supply of ink ribbon, including a span of ink ribbon which interposed between said print head and the print medium;

means for moving said print head and for advancing ink ribbon from said supply into said span as the print head is moved in at least one direction; and control means for directing print data to the print head; said control means including means for detecting when the printing density exceeds a predetermined value, and means responsive to said predetermined value being exceeded for moving the print head an amount greater than that necessary to position the print head at a succeeding print position so as to thereby cause additional ink ribbon to be advanced from supply and avoid overprinting on areas of the ink ribbon where high density printing has occurred.

BRIEF DESCRIPTION OF THE DRAWINGS

Some of the features and advantages of the invention having been described, others will become apparent from the detailed description which follows, when taken in connection with the accompanying drawings, in which.

DESCRIPTION OF THE ILLUSTRATED EMBODIMENT

Figure 1:
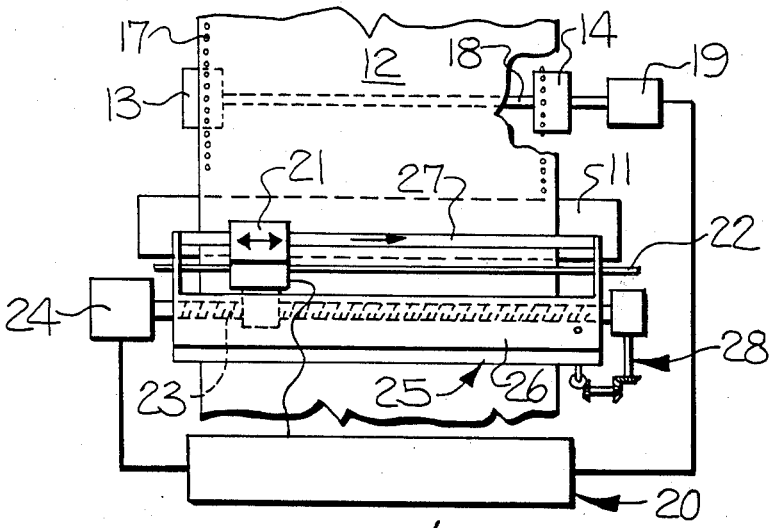
FIG. 1 is a schematic illustration of a printer showing the relationships of the print head to the ink ribbon and print medium.

The present invention will be described hereinafter with particular reference to the accompanying drawings which illustrate a specific embodiment or implementation of the present invention. It is to be understood at the outset, however, that it is contemplated that the present invention may be varied in specific detail from that illustrated and described herein while still achieving the desirable characteristics and features of the present invention. Accordingly, the description which follows is intended to be understood as a broad enabling disclosure directed to persons skilled in the applicable arts, and is not to be understood as restrictive. In particular, the invention is described herein as applied to a dot matrix printer of the type illustrated diagrammatically in FIG. 1. From this description, those skilled in the art will recognize that the invention may be useful with printers of a type and construction different from that specifically illustrated and described herein, and that the implementation of the principles of the present invention will vary from that described herein, depending upon the particular printer environment.

A dot matrix printer typically includes a platen 11 over which a print medium 12 is moved by means of a pair of tractor devices 13, 14 in the form of a wheel or belt having protruding pins 16 on the outer surface. The print medium may be, for example, a continuous web of paper having holes 17 parallel to the edges thereof. The pins 16 of the tractor devices engage the holes 17 formed in the web to provide a positive drive. The two tractors 13, 14 are mounted on a common shaft 18 which may be rotated as required by a motor 19 to advance the print medium over the platen 11. The motor 19 is controlled by a printer control means, generally indicated at 20.

The printer also includes a traversing print head 21 which is mounted for movement laterally across the print medium 12 by a support 22 which extends over the platen 11 so that the print medium 12 passes between the platen and the print head 21. The print head 21 can be moved along the support 22 by means of a rotating threaded shaft 23 driven by a motor 24.

The printer control unit, generally indicated at 20, includes means governing the data processing and mechanical functions of the printer, coordinates their respective operations, and may further communicate with a host computer to receive the print information which is to be printed. To this end, the printer control unit 20 includes a print medium controller means for providing signals to the motor 19 to control movement of the print medium 12 over the platen and past the print head; a print head controller means providing signals to motor 24 to control movement of the print head; and print head actuator means providing signals to actuate the individual printing elements of the print head 21. The control unit 20 further coordinates the flow of data to the print head with the physical movement of the print head. The printer control unit 20 also includes data buffer means into which print data is read when received and from which it is directed to the print head.

The printer also includes a supply of ink ribbon, generally indicated at 25. The ink ribbon may be in the form of a cloth ribbon, mylar film, or in any other suitable form. In the illustrated embodiment the ribbon is housed in an ink ribbon cartridge 26 and includes a span 27 of ink ribbon which is interposed between the print head 21 and the print medium 12. A mechanical linkage 28 interconnects the rotatable shaft 23 and the ribbon cartridge 26 so that actuation of the print head drive motor 24 to move the print head 21 will also cause fresh ribbon to be advanced from cartridge 26 into the span 27. Thus, as the print head 21 moves back and forth during printing, fresh ribbon will be continually advanced into the span 27. Depending upon the arrangement of the linkage, ribbon may be advanced either during movement of the print head in a single direction or during movement of the print head in both directions. The linkage may take the form of gears, pulleys or other suitable means. By way of example, one known linkage means for driving an ink ribbon during bidirection movement of the print head is shown in IBM Technical Disclosure Bulletin Volume 15, No. 7, December 1972.

The linkage 28 connecting the ink ribbon drive to the print head drive causes the ribbon to be advanced at a rate slower than the rate of print head movement. As a result, the impressions made by the print head on the ribbon are compressed and tend to overprint upon one another. During the printing of conventional text characters, the print density is normally low enough that the ink ribbon can provide adequate ink for printing the characters on the print medium. However, during the printing of dense patterns, such as may occur for example in printing graphics of high printing density, backgrounds, or certain text fonts, the movement of the ribbon is such that ink depletion may occur when successive dense patterns on a line overprint a section of the ribbon.

The present invention overcomes this problem by detecting when the printing density exceeds a predetermined threshold value and causing the print- head to move an amount greater than that necessary to position the print head at a succeeding print position so as to thereby cause additional ink ribbon to be advanced from the supply. This may be accomplished in various ways, depending upon the particular printer environment.

Before providing an illustration of one suitable way in which these operations may be carried out in accordance with the present invention, it may be helpful to first review certain operations of the particular printer illustrated herein in which the invention is utilized. As earlier noted, the printer control means 20 includes a data buffer means which receives and temporarily stores the print data until it can be directed to the print head. After the buffer of print data has been printed, the buffer means receives another buffer of data and the cycle is repeated.

When printing text, the buffer means may contain enough print data for printing an entire line or several entire lines of text. However, when printing certain modes of graphics which involve large volumes of binary data, several buffers of data may be required to print across the entire width of the print medium. Under these circumstances, the print head must be repositioned after printing each buffer of data so as to be at the proper print position for continuing printing with the next buffer of data. This repositioning phase is necessary due to the time required to accelerate the print head to constant speed for printing and to stop the head upon completion of printing. The repositioning may occur several times during the printing of a line. When extra print head movement is required for ribbon advancement pursuant to the present invention, the extra movement takes place during the print head repositioning phase.

Figure 4:
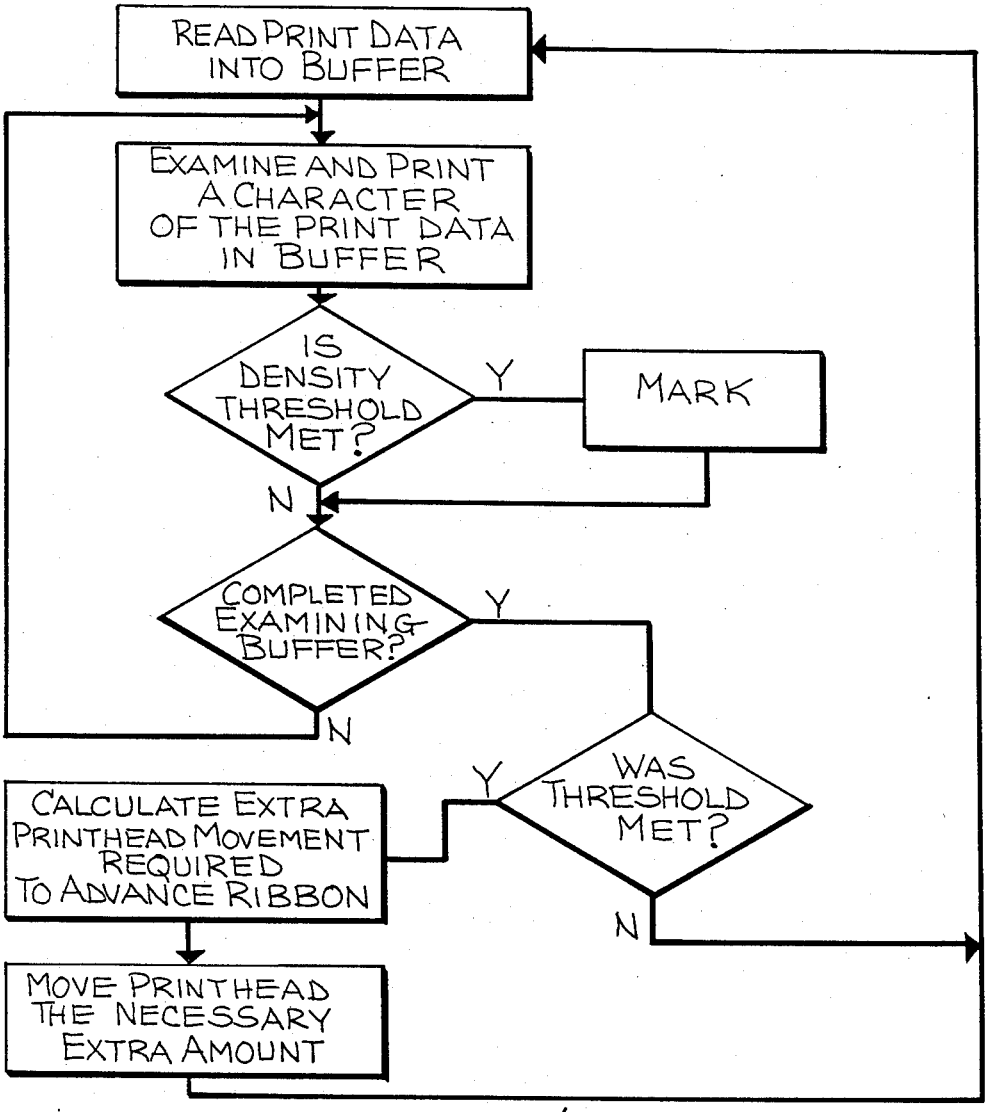
FIG. 4 is a flow chart illustrating the sequence of operations pursuant to the present invention.

A flow chart representing the sequence of operations pursuant to this implementation of the present invention is shown in FIG. 4, and will be explained more fully below. As illustrated, during the printing of each successive buffer of print data, the print buffer is examined to determine if the print density has exceeded a predetermined threshold level. In the printing of graphics characters, the examination of the print buffer may be carried out by counting the average number of dots per unit area and comparing the dot density value thus obtained with a predetermined dot density threshold. A similar approach may also be employed in the printing of text characters by determining whether any of the stored characters in the buffer are such as to produce a density above a predetermined threshold level. Alternatively, the determination of whether the printing density threshold level has been reached may be based upon whether the printer is printing in a particular print mode or font likely to produce high density printing.

Once it has been determined that the print density threshold value has been reached, then the print head will be moved an extra distance in order to advance additional fresh ribbon so as to avoid overprinting on areas of the ribbon where high density printing has previously occurred.

At this point, the additional extra travel which is required by the print head in order to advance the fresh ribbon is calculated. The calculation of this distance is best understood from the following discussion which derives an exemplary equation for carrier head movement. In this example, the parameters (in units of motor steps) are as follows:

$B_n$=actual length of the data buffer just printed.

$B_{n+1}$=actual length of the data buffer to be printed.

D=deceleration

A=acceleration

R=ratio of head movement to ribbon movement

S=gear slop distance which occurs at a change of direction of the print head.

Figure 2:
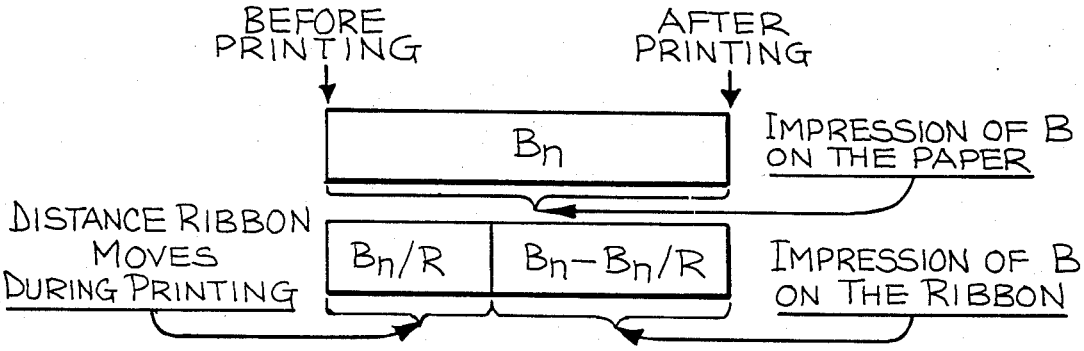
FIG. 2 illustrates diagramatically the impression made upon the print medium and upon the ink ribbon by the print head during printing.

Since the ribbon moves slower than the carrier by a factor of R, the impression of the print information in data buffer $B_n$ on the ribbon is $(B_n-B_n/R)$. This is illustrated in FIG. 2 where the upper block represents the impression of the print information in buffer $B_n$ on the paper, and the lower block illustrates the impression of the buffer $B_n$ on the ribbon as a result of the movement of the ribbon during printing a distance of $B_n/R$.

Figure 3:
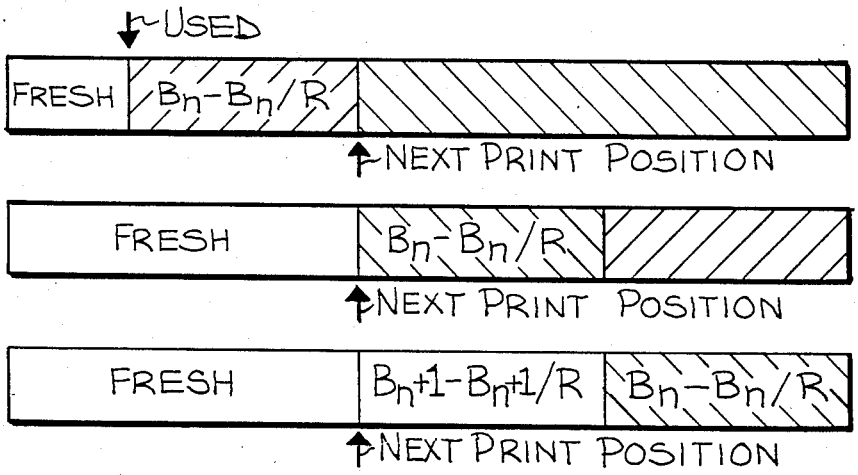
FIG. 3 illustrates diagramatically the amount of movement which is required to advance the ink ribbon for printing a buffer of print information.

After printing the buffer $B_n$, the ribbon needs to move a distance of $(B_n-B_n/R)$ to clear the portion of the ribbon just used in printing the buffer $B_n$ and an additional distance of $(B_{n+1}-B_{n+1}/R)$ to provide fresh ribbon in position for receiving the impression of the next buffer $B_{n+1}$ when printing is continued in the same direction. This is illustrated in FIG. 3 where the uppermost block illustrates the condition of the ribbon upon completion of printing the buffer $B_n$. The second block illustrates the appearance of the ribbon after it has been advanced to the right a distance of $B_n-B_n/R$ to clear the portion of the ribbon used in printing the buffer $B_n$. The lowermost block illustrates the position of the ribbon as it is ready to receive the next buffer $B_{n+1}$. At this point the ribbon has been advanced a distance of $B_n-(B_n/R)+B_{n+1}-(B_{n+1}/R)$.

Now in order for this much ribbon to be advanced, the carrier needs to be moved a total number of steps equal to $R\ (B_n-(B_n/R)+B_{n+1}-(B_{n+1}/R))$.

Figure 5:
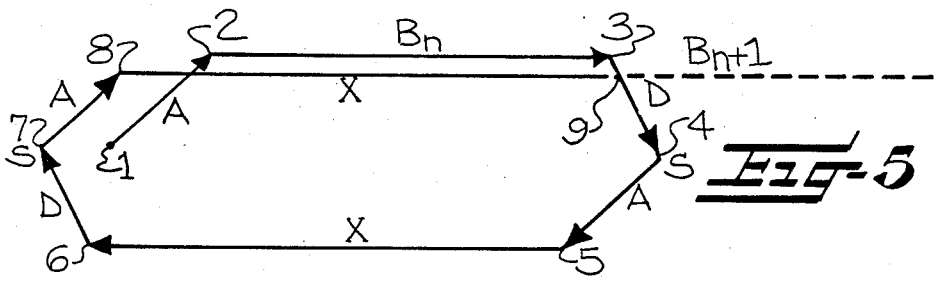
FIG. 5 is a graph illustrating the movement of the print head during printing of high density characters and advancement of fresh ribbon in accordance with this invention.

This extra distance that the print head carrier moves in the printing/repositioning phase is shown in FIG. 5. Referring to this figure, the numbered points are as follows:

1: Initial starting position of the print head carrier.

1-2: Acceleration of the carrier.

2-3: Printing phase of $B_n$.

3-9: Compensation distance to advance ribbon.

After 9 Printing phase of $B_{n+1}$.

Assuming that the ribbon is driven bi-directionally, from FIG. 5 the formula simplifies to:

$$R(B_n-(B_n/R)+B_{n+1}-(B_{n+1}/R))=2X+2(A+D-S). \quad (1)$$

X is the number of steps the carrier moves at a constant speed, and A and D are fixed for a given speed. Solving for X from equation (1), the equation simplifies to:

$$X=((R-1)/2)(B_n+B_{n+1})-(A+D-S) \quad (2)$$

For a undirectionally driven ribbon, the equation can be generalized to:

$$X=(R-1)\ (B_n+B_{n+1})-(A+D-S). \quad (3)$$

The foregoing derivation of the required amount of print head movement assumes the worst case of ink depletion, i.e. that an entire buffer $B_n$ of data depletes the entire section of ribbon allotted to the buffer. In reality, however, there are many cases where the major ink depletion occurs past the buffer beginning. By introducing an additional variable, fired pattern density, the print head movement can be minimized. The density of the fired pattern is the main factor causing ink depletion. Therefore, pattern density can be tracked in order to minimize carrier movement.

Figure 6:
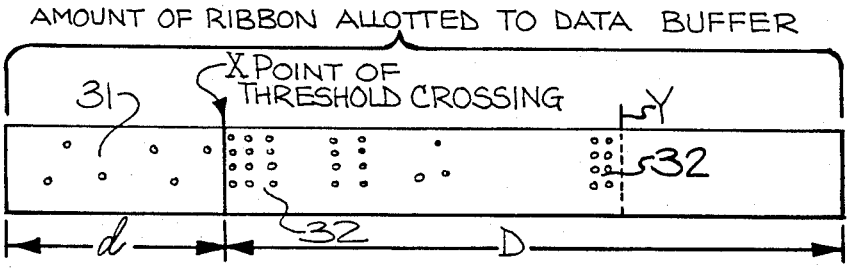
FIG. 6 illustrates diagramatically how the firing pattern density may be examined to minimize ribbon consumption.

There is an experimental threshold level of pattern density where the ribbon can safely accept new fire patterns before recycling. This threshold level is ribbon and application dependent. To determine the point on the ribbon which crosses the threshold value, the dot distribution is successively calculated for small incremental portions of the buffer. For example, after every graphic character, (12 fires), the dot distribution is calculated and a test is made whether this dot distribution crosses the critical threshold value. When the dot distribution exceeds this value, the location of the occurrence is marked. Thus as illustrated in FIG. 6, the pattern of dots indicated at 31 are relatively sparsely distributed, while the dots indicated at 32 form a high density graphics character. The first occurrence of the high density dots 32 is indicated at X and represents the point where threshold crossing occurred. The ribbon to the left of this threshold crossing d, which is below the threshold level, is the distance of ribbon which can be reused for the next buffer, while the remaining distance D of ribbon to the right of the point of threshold crossing is considered as used. In accordance with a further aspect of the invention, the locations of subsequent threshold crossings can also be marked (e.g. the last as well as the first) so as to thereby determine depleted regions of the ribbon, and suitable logic can be applied to maximize reuse of undepleted regions of the ribbon while avoiding overprinting on the thus identified depleted regions. Thus for example, as indicated in FIG. 6, the last occurrence of a high density pattern 32 is indicated at Y, and the region between X and Y represents a depleted region of the ribbon which cannot be reused, while the region to the right of the point Y could be reused under appropriate circumstances.

That which is claimed is:

1. A printer for printing data on a print medium comprising a print head mounted for movement relative to a print medium;

a supply of ink ribbon, including a span of ink ribbon which is interposed between said print head and the print medium;

means for moving said print head and for advancing ink ribbon from said supply into said span in response to movement of the print head in at least one direction; and control means for directing print data to said print head and controlling movement of the print head;

said control means including means for detecting when the printing density exceeds a predetermined value; and means repsonsive to said predetermined value being exceeded for moving said print head an amount greater than that necessary to position the print head at a succeeding print position so as to thereby cause additional ink ribbon to be advanced from said supply and avoid overprinting on areas of the ink ribbon where high density printing has occurred.

2. A printer as set forth in claim 1 wherein said control means also includes means for computing the amount of additional movement of said print head which is required to advance ink ribbon to the next succeeding print position of the print head.

3. A printer as set forth in claim 1 wherein said means for detecting when the printing density exceeds a predetermined value comprises means for discriminating between several printing modes of different density.

4. A printer as set forth in claim 1 wherein said control means for directing print data to said print head includes data buffer means for storing print data to be directed to said print head, and wherein said means for detecting when the printing density exceeds a predetermined value comprises means for examining the print data in said data buffer means.

5. A printer as set forth in claim 4 wherein said means for examining the print data in said data buffer means includes means for examining the density of the print data in successive incremental portions of the data buffer means and means for recording the location of the incremental portion containing the first occurrence when the density of the print data exceeds said predetermined value.

6. A printer as set forth in claim 4 wherein said means for examining the print data in said data buffer means includes means for examining the density of the print data in successive incremental portions of the data buffer means and means for recording the locations of the incremental portions where the density of the print data exceeds said predetermined value to thereby determine the depleted regions of the ribbon.

7. A printer for printing data on a print medium comprising a dot matrix print head mounted for movement laterally across a print medium;

a supply of ink ribbon, including a span of ink ribbon which is interposed between said print head and the print medium;

power means for moving said print head across the print medium;

linkage means coupled to said power means for advancing ink ribbon from said supply into said span in response to movement of said print head in at least one direction; and control means for directing print information to said print head and controlling operation of said power means;

said control means including data buffer means for storing successive buffers of print data to be directed to said print head;

means for examining each successive buffer of print information and for detecting when the dot density thereof exceeds a predetermined value; and means responsive to said predetermined value being exceeded for moving said print head an amount greater than that necessary to position the print head at a succeeding print position so as to thereby cause additional ink ribbon to be advanced from said supply.

8. A printer according to claim 7 wherein said control means also includes means for examining the content of the current buffer of print data and the content of the next succeeding buffer of print data and for computing therefrom the amount of additional movement of said print head which is required to advance sufficient ink ribbon into position for receiving printing of said next succeeding buffer of print data.

9. A method for advancing the ink ribbon in a printer of the type in which a print head is driven laterally across a print medium and a span of ink ribbon is interposed between the print head and the print medium, and wherein ink ribbon from a supply is advanced into said span in response to movement of the print head in at least one direction; said method comprising detecting when the printing density exceeds a predetermined value, and in response to said predetermined value being exceeded, moving said print head an amount greater than that necessary to position the print head at a succeeding print position so as to thereby cause additional ribbon to be advanced from said supply and avoid overprinting on areas of the ink ribbon where high density printing has occurred.

10. A method according to claim 9 including the additional step of computing the amount of additional movement of the print head which is required to advance ink ribbon to the next succeeding print position of the print head.

11. A method according to claim 9 wherein said step of detecting when the print density exceed a predetermined value comprises discriminating between several different printing modes of different density.

12. A method according to claim 9 wherein the printer prints successive buffers of print data as the print head is moved across the print medium, and wherein said step of detecting when the printing density exceeds a predetermined value comprises examining each successive buffer of print data.

13. A method according to claim 12 including the steps of examining the content of the current buffer of print data and the content of the next succeeding buffer of print data and computing therefrom the amount of additional movement of the print head which is required to advance sufficient ink ribbon into position for receiving printing of said next succeeding buffer of print data.

14. A method according to claim 13 wherein said step of examining comprises examining the density of the print data in successive incremental portions of the buffer of print data and recording the location of the incremental portion containing the first occurrence when the density of the print data exceeds said predetermined value, and wherein in said step of computing the amount of additional print head movement required to advance the ribbon, the previously used portion of ink ribbon prior to said first occurrence is reused to thereby reduce ribbon consumption.

* * * * *